US005388709A

United States Patent [19]

Adams

[11] Patent Number: 5,388,709

[45] Date of Patent: Feb. 14, 1995

[54] GARDEN EQUIPMENT SUPPORT RACK

[76] Inventor: Thomas F. Adams, 3961 E. River Dr., Fort Myers, Fla. 33916

[21] Appl. No.: 176,095

[22] Filed: Dec. 30, 1993

[51] Int. Cl.[6] ..... A47F 5/00

[52] U.S. Cl. ..... 211/70.6; 211/106; 211/66; 248/218.4; 248/220.4

[58] Field of Search ..... 211/59.1, 70.6, 87, 211/106, 107, 65, 66; 248/218.4, 219.1, 219.4, 220.2, 220.4

[56] References Cited

U.S. PATENT DOCUMENTS

| | | | |
|---|---|---|---|
| 1,714,201 | 5/1929 | West | 211/106 |
| 3,153,526 | 10/1964 | Pawsey | 248/219.1 |
| 3,721,348 | 3/1973 | Cook | 211/70.6 |
| 3,817,394 | 6/1974 | Saiki | 248/218.4 X |
| 4,015,809 | 4/1977 | Buril | 248/218.4 X |
| 4,093,168 | 6/1978 | Buril | 248/218.4 X |
| 4,167,255 | 9/1979 | Benson | 248/218.4 X |
| 4,318,486 | 3/1982 | Bobrowski | 211/87 |
| 4,467,925 | 8/1984 | Ratzloff et al. | 211/60 |
| 4,723,663 | 2/1988 | Learn | 248/220.4 X |
| 4,742,923 | 5/1988 | Calvert | 248/220.4 X |
| 5,143,228 | 9/1992 | Arnold | 211/70.6 |

*Primary Examiner*—Robert W. Gibson, Jr.
*Attorney, Agent, or Firm*—Robert G. Mentag

[57] ABSTRACT

A garden equipment support rack for mounting on an upright post having a front face and two side surfaces, such as a building wall stud, and on upright posts on movable structures, such as on landscape trucks. The support rack includes at least one elongated hook member having an inner end structure joined to a mounting structure for positioning the hook member on an upright post. The mounting structure is provided with positioning arms for seating against at least one side of an upright post, and attachment screws are employed for fixedly securing the mounting structures to the upright post. The mounting structure may carry a pair of spaced apart hook members, which may be adjustably mounted, for sideward adjustment, on the mounting structure, or which may be mounted in spaced apart fixed positions on the mounting structure.

9 Claims, 2 Drawing Sheets

20
18
44
22
48
50
42
12
52
46
43
10
58
26
40
56
64
54
60
62
28
30
38
36
32
34

14
52
40
46
10
30
28
26
20
18
48
60
38
36
34
12
62
32
54
52
64
16

14
18
24
22
20
58
16
12
24
56
54

20a
44a
22a
12a
18a
46b
66b
68b
40a
52a
68
65
46a
26a
66
26b
30a
30b
43a
54a
38a
36a
70b
56a
28a
70
36b
60a
72b
52a
38b
34a
72
60b
32b
69
28b
34b
32a

GARDEN EQUIPMENT SUPPORT RACK

BACKGROUND OF THE INVENTION

1. Field of the Invention

The field of art to which this invention pertains may be generally located in the class of devices relating to support racks. Class 211, Supports, Racks, United States Patent Office Classification, appears to be the applicable general area of art to which the subject matter similar to this invention has been classified in the past.

2. Description of the Prior Art

This invention relates to garden equipment support racks for mounting to a wall, or the like, for removably supporting one or more garden tools or other miscellaneous items. Heretofore, various wall mounted storage racks have been proposed for supporting and storing garden tools such as racks, shovels, brooms, hoes, and the like. Garden equipment support racks are presently available which include a wall mounted, horizontal disposed rail with a plurality of horizontally mounted side rails or hooks projecting forwardly from said horizontal rail. The U.S. Patents to Ratzloff, U.S. Pat. No. 4,467,925, and Arnold, U.S. Pat. No. 5,143,228 disclose garden tool storage racks which require a wall supported, horizontal rail which spreads out sidewardly of the rack structure. A disadvantage of the aforementioned garden tool storage racks, which require a wall supported, horizontal rail is that such storage racks cannot be employed in circumstances where only a limited wall space is available, whereby only short wall supported horizontal rails may be employed, which results in limited tool storage capacity. The aforementioned prior art wall mounted support racks, which require horizontal rails, cannot be mounted with one support rack above another, to provide extra storage capacity because of the long handles of garden tools mounted on such support racks. A further disadvantage of the aforedescribed wall supported storage racks is that they are not compact in structure for shipping purposes nor for display purposes in retail stores.

The support rack shown in the Arnold patent has a further disadvantage in that it includes a garden basket which uses wall space which otherwise would be available for tool storage. Still another disadvantage of the Ratzloff support rack is that the projecting pair of side rails employed by such racks do not have structural design integrity, in that they do not project forwardly enough to hold more than about two tools per hook, and they lack vertical support whereby if they are fully loaded, they may fail due to structural weakness since the weight of the tools mounted thereon can cause such unsupported hooks or side rails to bend downwardly causing the tools to slide off and fall down, and possibly cause injury to any person near such support racks. Each pair of hooks or side rails employed in the Ratzloff and Arnold support racks are fixed relative to each other and cannot be adjusted sidewise to provide different widths therebetween for special purposes for storing extra wide items, such as a pick ax or extra narrow items, as hand trowels. Other conventional support racks employ hooks which are seated in holes in peg boards or hang on an expansion shield supported by wall boards, but such support racks have a limited tool supporting capacity.

SUMMARY OF THE INVENTION

The present invention provides a garden equipment support rack which is compact and self contained in construction, and which is adapted to be mounted directly to an upright post, such as a building wall stud, or the like. The support rack of the present invention does not require any horizontal disposed wall rail. One embodiment of the invention includes a single hook support rack for use in storing "D" shaped handled tools such as saws, electric edgers and other items, such as coils of rope, cords, hoses, and the like. A second embodiment of the invention comprises a double hook support rack construction which is particularly useful for storing rakes, shovels, brooms, hoes and like items, and which when mounted close to the roof, or ceiling, of a room in which they are mounted may "lock in" the tools carried thereon by positioning a deep throat (bicycle type) padlock across the free ends of two hooks (just outside the tools thereon) to prevent pilferage of the tools.

The single hook and double hook support rack embodiments of the invention are each provided with a mounting structure that is designed to seat against or hug at least one or both side surfaces of a building wall stud, to insure that the support rack is precisely centered on the face of the stud before fastening or securing the support rack to the stud, and to prevent twisting or downward bending under heavy load conditions so as to cause tools stored thereon to shift or slip off the support rack.

The single hook and double hook support racks are compact, light in weight, strong and have good structural integrity, since each support rack includes an upper metal rod support member which is in tension and a lower metal rod support member which is in compression, so as to provide triangular structural integrity. The single hook and double hook support racks are compact in width and height, and they project out a long distance forward from the face of a stud on which they are mounted on, as for example, over a foot, and they have the capacity to store a plurality of tools as for example, 6 to 10 tools. The mounting structure of the single hook and double hook support racks is fastened direct to the face of a stud, either a bare stud or a drywall covered stud, with large size dry wall style wood screws, or the like. When secured in place on a stud, a support rack of the present invention is cantilevered out from the stud and can hold well over a hundred pounds, since the support rack is securely mounted directly to the stud, which is a building structural member and it becomes an extension of the building structure. A single hook or double hook support rack of the present invention comprises a compact, high tool load capacity support rack which may be quickly and easily mounted anywhere there is a need for a tool support rack and a conveniently located stud. A user of a support rack made in accordance with the present invention, may buy a number of either the single hook or double hook support racks in accordance to his tool storage needs.

The mounting structure for either a single hook or double hook support rack embodiment of the present invention may comprise a channel shaped support member which fits on the outer face of a building stud and which has two lips or flanges that seat against the two sides of the stud. A second type of mounting structure that may be employed with either the single hook or double hook support rack embodiment of the invention comprises a mounting structure integrally joined to or welded to, a metal rod structure employed to form the hook structure of the support rack. dr

DETAILED DESCRIPTION OF THE PREFERRED EMBODIMENTS

Figure 1:
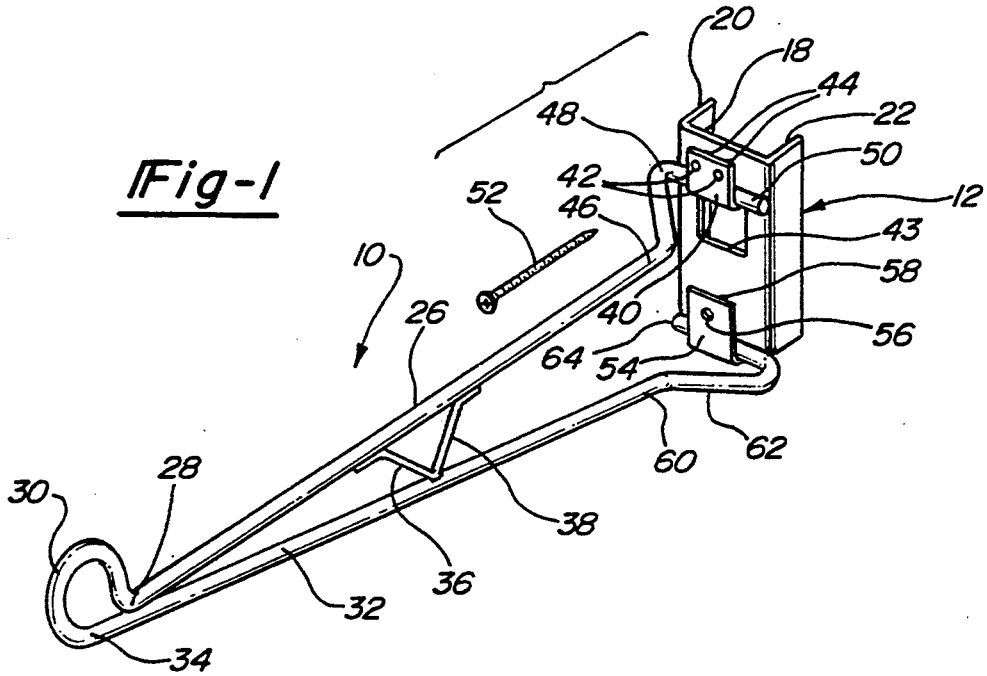
FIG. 1 is an elevation perspective view, with a single hook support rack embodiment made in accordance with the principles of the invention.
Figure 2:
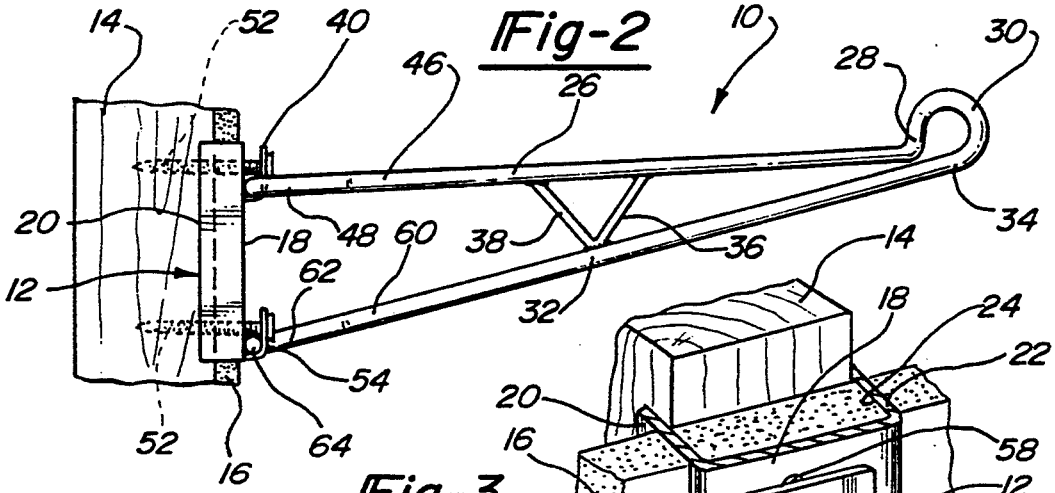
FIG. 2 is a side elevation view of the single hook support rack illustrated in FIG. 1, and showing the single hook support rack mounted on a building wall stud by a channel mounting structure that has channel flanges mounted through a wall board onto the face of the stud.
Figure 3:
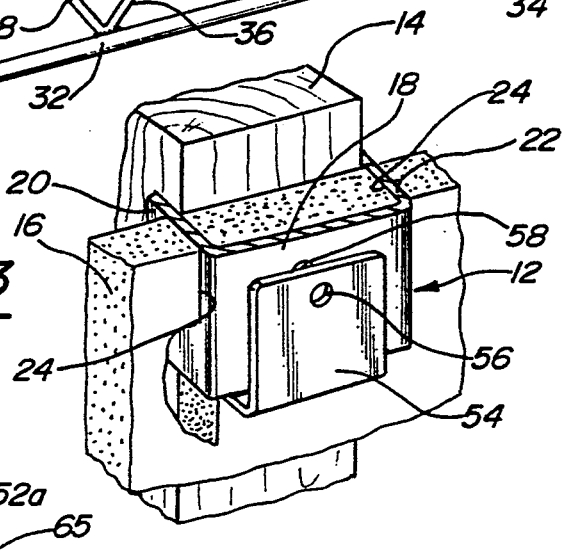
FIG. 3 is a partial, front elevation perspective view of the single hook support rack channel mounting structure shown in FIG. 2, and with the single hook support rack removed.

Referring now to the drawings, and in particular to FIGS. 1 and 2, the numeral 10 generally designates a single hook support rack made in accordance with the principles of the present invention. The single hook support rack 10 includes a mounting structure in the form of a channel member, generally indicated by the numeral 12. FIGS. 2 and 3 show the channel mounting structure 12 operatively mounted on a building wall stud 14 which has the outer face thereof covered with a conventional wall board 16.

As best seen in FIG. 1, the channel mounting structure 12 includes a channel front wall 18 and a pair of integral flanges or lips 20 and 22 formed along the outer vertical edges of the channel front wall 18. As illustrated in FIG. 3, the channel mounting structure 12 may be mounted on a stud 14 if it is covered by a wall board 16 by first locating the stud 14 on which it is to be mounted and then using a key hole saw to cut a slot 24 on each side of the stud 14. The channel mounting structure 12 may then be slidably mounted through the slots 24 to seat and position the flanges or lips 20 and 22 on the sides of the stud 14. Alternatively, the channel mounting structure flanges or lips 20 and 22, may be hammered through a wall board 16 covering a stud 14 to position the channel mounting structure 12 on a stud 14. The channel mounting structure 12 is designed to hug both sides of the stud 14 to be sure that the single hook support rack 10 is precisely centered on the face of the stud 14 before fastening the same to the stud 14, and to prevent twisting or bending under hard and extreme use load conditions which could cause tools carried on the single hook support rack 10 to shift and/or slip off of the support rack.

The channel mounting structure 12 may be made from any suitable material, as for example from sheet metal. Conventional building studs 14 now available on the market are mostly made to a width of $1\frac{1}{2}$ inches. Accordingly, the width between the channel mounting structure flanges or lips 20 and 22 may be formed on the side edges of the channel front wall 18 so as to provide an opening therebetween of exactly $1\frac{1}{2}$ inch. If a user of a single hook support rack 10 encounters an old size stud 14 having a width of $1\frac{5}{8}$ of an inch, then the opening or space between the channel mounting structure flanges or lips 20 and 22 may be enlarged slightly by hammering the flanges or lips 20 and 22 outwardly sidewise to slightly open the internal space between said flanges or lips 20 and 22, for positioning the channel mounting structure 12 on the old size $1\frac{5}{8}$ inch stud.

As shown in FIGS. 1 and 2, the single hook support rack 10 includes a horizontally disposed, elongated upper metal rod member 26 which has its front end 28 integrally connected to the lower end of the rear leg of a vertically disposed semicircular metal rod connector member 30. The single hook support rack 10 further includes an elongated lower metal rod member 32 which is disposed below the elongated upper metal rod member 26, and in vertical alignment therewith, but which slopes rearwardly and downwardly toward the channel mounting structure 12 to form a triangular arrangement with the elongated upper metal rod member 26. The front end 34 of the elongated lower metal rod member 32 is integrally connected to the lower end of the front leg of the vertically disposed semicircular metal rod connector member 30. The vertically disposed semicircular metal rod connector member 30 extends upwardly above the upper surface of the horizontally disposed elongated upper metal rod member 26 to provide a stop member, to prevent tools mounted on the single hook support rack 10 from sliding off of the same. As shown in FIGS. 1 and 2, the single hook support rack 10 is provided with a V-shaped brace between the elongated upper metal rod member 26 and the elongated lower metal rod member 32. The V-shaped brace includes a pair of metal rod legs 36 and 38 which are disposed in a V-shaped arrangement and have their upper ends welded to the lower side of the elongated upper metal rod member 26 and their lower ends joined together and welded to the upper side of the elongated lower metal rod member 32.

As shown in FIG. 1, an upturned flange 40 is struck out of the front wall 18 of the mounting structure 12 and it extends upwardly from an opening 43, in said channel front wall 18 from which the flange 40 is struck. The mounting structure flange 40 is provided with a pair of horizontally disposed attachment screw holes 42, which are aligned with a mating pair of attachment screw holes 44 that are formed through the upper end of the mounting structure channel front wall 18. As shown in FIG. 1, the inner end of the single hook elongated upper metal rod member 26 is designated by the numeral 46 and it is integrally connected to the front end of a joint means integral metal rod portion 48 which is curved outwardly and integrally attached at its rear end to a transversely disposed joint means metal rod arm 50.

The joint means metal rod arm 50 is seated between the flange 40 and the channel front wall 18 of the mounting structure 12. A pair of suitable attachment screws, such as the screw 52 indicated in FIGS. 1 and 2, are operatively mounted through the attachment holes 42 and 44 for fixedly securing the last described joint means members 48 and 50 for the single hook elongated upper metal rod member 26 to the mounting structure 12, and the mounting structure 12 to the stud 14.

As shown in FIGS. 1 and 3, an upwardly extending flange 54 is integrally formed on the lower end of the front wall 18 of the mounting structure 12. The upwardly extending flange 54 is provided with an attachment screw hole 56 adjacent the upper end thereof and it is aligned with a mating attachment screw hole 58 formed through the front wall 18 of the mounting structure 12. As shown in FIG. 1, the inner end of the single hook elongated lower metal rod 32 is designated by the numeral 60, and it is integrally connected to the front end of a joint means integral metal rod portion 62 which is curved outwardly and integrally attached at its rear end to a transversely disposed joint means metal rod arm 64. The joint means metal rod arm 64 is seated between the integral flange 54 and the channel front wall 18 of the mounting structure 12. A suitable attachment screw, such as the screw 52 shown in FIG. 2, is operatively mounted through the attachment holes 56 and 58 for fixedly securing the last described joint means member of the single hook elongated lower metal rod member 32 to the mounting structure 12, and the mounting structure 12 to the stud 14.

In use, the mounting structure 12 must first be positioned on a stud 14 in the desired location thereon. The elongated hook member comprising the upper and lower metal rod members 26 and 32 would then have the joint structure members 50 and 64 positioned in the mounting structure flanges 40 and 54. The single hook support rack 10 would then be fixedly secured to the stud 14 by driving three dry wall screws 52 through the screw holes 42, 44, 56 and 58 to complete the mounting of the single hook support rack 10 on the stud 14. Although the single hook support rack 10 has been illustrated in FIGS. 2 and 3 as being mounted on a building wall stud 14, it will be understood that it may be mounted on any upright post having a front face and two side surfaces, even on movable structures such as a post on a truck, such as one used for landscape work, and the like.

Figure 4:
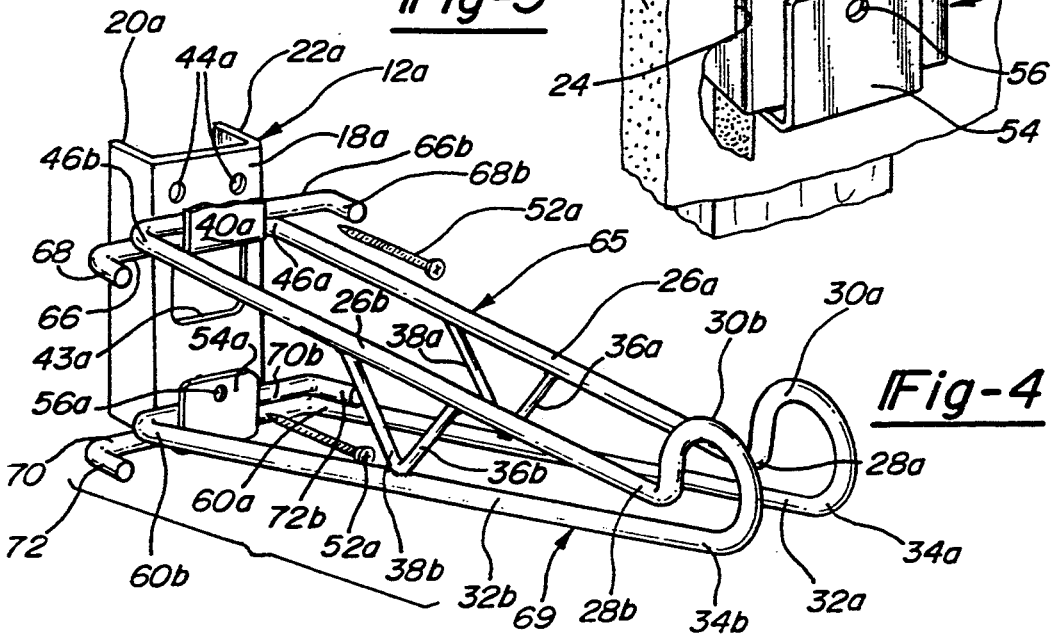
FIG. 4 is a front elevation view of a double hook support rack employing two of the single hook support racks shown in FIG. 1, and which are adjustable sidewise on a channel mounting structure as illustrated in FIG. 1.

FIG. 4 is a perspective view of a double hook support rack embodiment which employs a pair of single hook members, generally designated by the reference numerals 65 and 69, and which are constructed substantially similar to the single hook member disclosed in FIGS. 1 and 2. The single hook member 65 and associated structure employed in the embodiment of FIG. 4 are marked with the same reference numerals as used in the embodiment of FIGS. 1 and 2, followed by the small letter "a".

The elongated upper metal rod member **26*a* of the single hook member 65 is provided with a transverse metal rod joint arm 66 which has one end integrally attached to the rear end 46*a* of the upper metal rod member 26*a*. The other end of the transverse metal rod joint arm 66 has integrally attached thereto a metal rod stop member 68 which extends forwardly and parallel to the elongated upper metal rod member 26*a*. The elongated lower metal rod member 32*a* of the single hook member 65 is also provided with a transverse metal rod joint arm 70 which has one end integrally attached to the rear end 60*a* of the lower metal rod member 32*a*. The other end of the transverse metal rod joint arm 70 has integrally attached thereto a metal rod stop member 72 which extends forwardly and parallel to the elongated lower metal rod member 32*a***.

The other single hook member 69 is marked with the same reference numerals as used on the single hook member of FIGS. 1 and 2, followed by the small letter "b". The single hook member 69 is also provided with upper and lower transverse metal rod joint members **66*b* and 70*b*, and adjustment stop members 68*b*, and 72*b***.

In use the two single hook members of the embodiment of FIG. 4 are mounted on the channel shaped mounting structure **12*a*, and adjusted sidewise to a desired width space position relative to each other, and they are then secured in position on a vertical post, a stud 14 or similar vertical support member by a plurality of suitable attachment screws 52*a* through the mounting flanges 40*a* and 54*a*. The stop members 68 and 72, and 68*b* and 72*b* limit the sidewise outward width adjustment of the two single members 65 and 69**, respectively.

Figure 5:
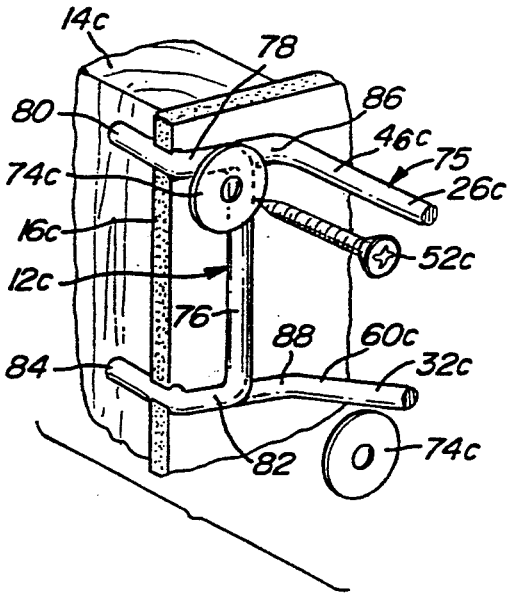
FIG. 5 is a partial, elevation perspective view of a single hook support rack of the construction shown in FIGS. 1 and 2, and which employs a first type metal rod mounting structure for positioning a single hook support rack on a building wall stud.

FIG. 5 is a partial, elevation perspective view of a single hook member 75 of the construction shown in FIGS. 1 and 2, but which employs a first type metal rod mounting structure for positioning a single hook support rack on a building wall stud. The parts of the single hook member 75 employed in the embodiment of FIG. 5 have been marked by the same reference numerals as used for the single hook member in FIGS. 1 and 2, followed by the small letter "c".

The metal rod mounting structure employed in the embodiment of FIG. 5 is generally designated by the numeral **12*c*, and it includes a vertical metal rod spacer member 76 which would be disposed along the vertical center line of a stud 14*c*. The upper end of the vertical metal rod spacer member 76 is integrally attached to one end of an upper transverse mounting arm member 78 which has integrally formed on the other end thereof an upper positioning metal rod member 80 that is disposed at a right angle to the transverse mounting metal rod arm 78, and adapted to be seated against the adjacent side of a stud 14*c*. A lower transverse mounting metal rod arm member 82 has one end integrally attached to the lower end of the vertical metal rod spacer member 76. Integrally formed on the other end of the transverse mounting metal rod arm member 82, and extending rearwardly at a right angle thereto, is a lower positioning metal rod member 84 which is disposed at a right angle to the lower transverse mounting metal rod arm member 82, and adapted to be seated against the same side of the stud 14*c* as is the upper positioning metal rod member 80**.

As shown in FIG. 5, the rear end **46*c* of the elongated upper metal rod 26*c* of the single hook member 75 is integrally connected to one end of an upper transverse metal rod joint arm 86. The other end of the transverse metal rod joint arm 86 is welded to the junction point of the upper end of the mounting structure vertical spacer member 76 and the upper transverse metal rod arm member 78. The rear end 60*c* of the elongated lower metal rod member 32*c* of the single hook member 75 is integrally connected to one end of a lower transverse metal rod joint arm 88. The other end of the transverse metal rod joint member 88 is welded to the lower end of the mounting structure vertical metal rod spacer member 76 at the junction point thereof with the lower transverse mounting structure metal rod arm member 82**.

The single hook support rack illustrated in FIG. 5 is attached to the stud 14*c* by a pair of suitable dry wall attachment screws 52*c* mounted through metal washers 74*c*. The attachment washers 74*c* may be welded to the metal rod mounting structure 12*c* at the juncture points between the transverse metal rod mounting structure arms 78 and 82, and the mounting structure vertical metal rod spacer member 76 so that they function as structural reinforcement members.

In use the single hook support rack illustrated in FIG. 5 may be mounted on a stud 14*c*, which is covered by a dry wall 16*c*, by first locating the stud 14*c* and then drilling two holes along the left side of the stud 14*c*, as viewed in FIG. 5. The metal rod mounting structure 12*c* may then be mounted in place by inserting the two positioning metal rod members 80 and 84 in the drilled holes, and then hammering the mounting structure 12*c* into place and applying the aforedescribed attachment washers 74*c* and attachment screws 52*c*.

Figure 6:
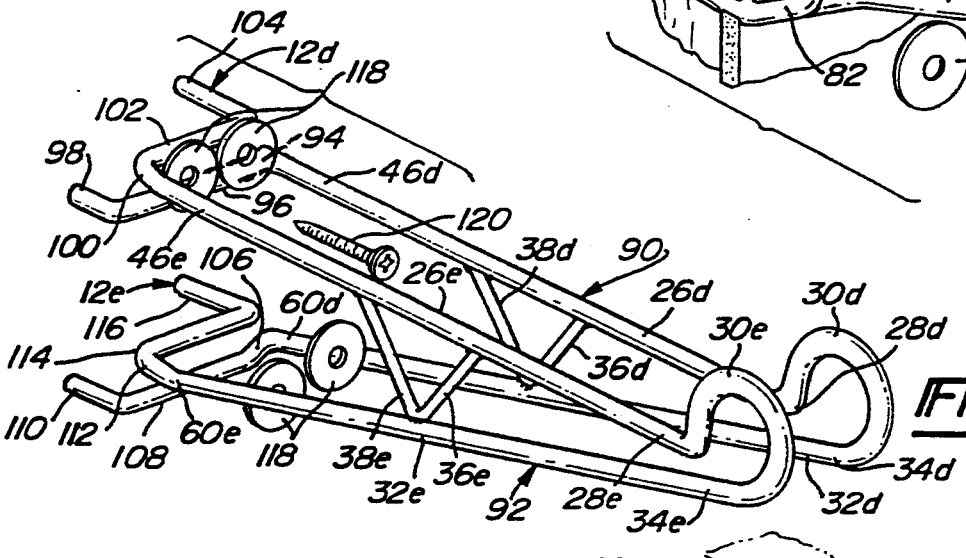
FIG. 6 is an elevation perspective view of a double hook support rack construction as shown in FIG. 4, but which employs a second type metal rod mounting structure.

FIG. 6 is a perspective view of a double hook support rack embodiment which employs a pair of single hook members, generally designated by the reference numerals 90 and 92, and which are constructed substantially similar to the single hook member disclosed in FIGS. 1 and 2, but which employs a second type metal rod mounting structure for positioning the double hook rack on a building wall stud. The single hook members 90 and 92 associated structure employed in the embodiment of FIG. 6 are marked with the same reference numerals as used in the embodiment of FIGS. 1 and 2 followed by the small letters "d" and "e", respectively.

The elongated upper metal rod member 26*d* of the single hook member 90 is provided with a downwardly bent transverse metal rod joint arm 94 which has one end integrally attached to the rear end 46*d* of the upper metal rod member 26*d*. The other end of the transverse metal rod joint 94 has integrally attached thereto one end of a transverse mounting structure metal rod arm 96. The other end of the transverse mounting structure metal rod arm 96 has integrally attached thereto a mounting structure positioning arm 98, which extends rearwardly at a right angle and is disposed parallel to the elongated upper metal rod member 26*d*. The elongated upper metal rod member 26*e* of the single hook member 92 is provided with an upwardly bent metal rod joint arm 100 which has one end integrally attached to the rear end 46*e* of the elongated upper metal rod member 26*e* and the other end integrally attached to one end of a transverse mounting structure metal rod arm 102. The other end of the transverse mounting structure metal rod arm 102 is integrally attached to a mounting structure positioning arm 104 which extends rearwardly at a right angle thereto and is parallel to the elongated upper metal rod member 26*e*. An upper pair of metal washers 118 are welded to the mounting structure transverse arms 96 and 102 to hold them vertically spaced apart to permit passage therebetween of a pair of attachment screws 120, and to hold the positioning arms 98 and 104 one and a half inches apart. The mounting structure members 96, 98, 102 and 104, and the two upper welded washers 118 comprise an upper portion of a mounting structure for the double hook support rack embodiment of FIG. 6 and is generally indicated by the numeral 12*d*.

The elongated lower metal rod member 32*d* of the single hook member 90 is provided with a downwardly bent transverse metal rod joint arm 106 which has one end integrally attached to the rear end 60*d* of the lower metal rod member 32*d*. The metal rod joint arm 106 is integrally attached to one end of a mounting structure transverse arm 108. The other end of the mounting structure transverse arm 108 is integrally attached to one end of a mounting structure metal rod positioning arm 110, which extends rearwardly at a right angle to the mounting structure transverse arm 108 and which is parallel to the elongated lower metal rod member 32*d*. The elongated lower metal rod member 32*e* of the single hook member 92 is provided with a metal rod joint arm 112 which has one end integrally attached to the rear end 60*e* of the lower metal rod member 32*e*. The metal rod joint arm 112 is bent upwardly and has the other end thereof integrally attached to one end of a mounting structure transverse metal rod arm 114. The other end of the mounting structure transverse metal rod arm 114 has integrally attached thereto a mounting structure positioning arm 116 which is bent at a right angle and extends rearwardly and is disposed parallel to the elongated lower metal rod arm member 32*e*. In practice, a lower pair of metal washers 118 are welded (In FIG. 6, they are not welded for clarity purposes) to the mounting structure transverse arms 108 and 114 to hold them vertically spaced apart to permit passage therebetween of a pair of attachment screws 120, and to hold the positioning arms 110 and 116 one and a half inches apart.

The lower portion 12*e* of the mounting structure for the double hook support rack embodiment of FIG. 6 includes the two transverse members 108 and 114, the two positioning arms 110 and 116, and the two lower welded washers 118. The two upper mounting structure positioning arms 98 and 104 are vertically aligned with the two lower mounting structure positioning arms 110 and 116, respectively when they are in an operative position on a building wall stud, or other upright post.

In use, the two single hook members 90 and 92 are secured together in a single assembly, by the welded washers 118, which would be mounted on a building wall stud by positioning the mounting structure metal rod positioning arms 98 and 110 against one of the side surfaces of the stud and the other two mounting structure positioning arms 104 and 116 against the other side surface of the stud. The double hook support rack embodiment of FIG. 6 would then be fixedly secured to the stud by means of the two pairs of welded attachment washers 118 and two pairs of suitable dry wall attachment screws 120. One pair of welded attachment washers 118 and attachment screws 120 would be employed for attaching the upper portion 12*d* of the mounting structure to the stud and the second pair of welded attachment washers 118 and attachment screws 120 would be employed to fixedly secure the lower portion 12*e* of the mounting structure to the stud. It will be understood that the attachment screws 120 are adapted to pass in between the mounting structure transverse arms 96 and 102, and between the mounting structure transverse arms 108 and 114.

The double hook support rack of FIG. 6 may be mounted on a building wall stud covered by dry wall, by first locating a suitable stud and then drilling two holes along each side of the stud. The metal rod upper and lower mounting structures 12*d* and 12*e* may then be mounted in place on the stud by inserting the four positioning metal rod members 98, 104, 110 and 116 in the drilled holes, and then hammering the mounting structures 12*d* and 12*e* into place and applying the aforedescribed attachment screws 120 through the welded attachment washers 118.

Figure 7:
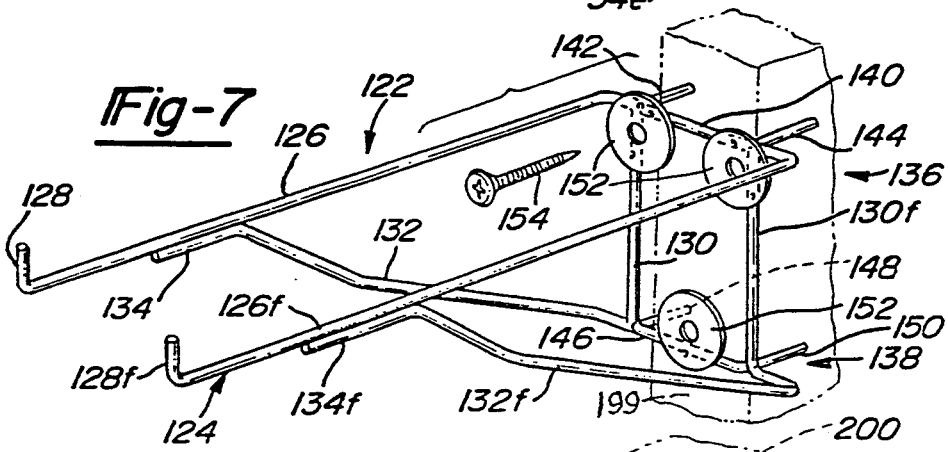
FIG. 7 is an elevation perspective view of a second embodiment of a double hook support rack which employs a third type metal rod mounting structure.

FIG. 7 is a perspective view of a double hook support rack embodiment which employs a pair of single hook members, generally designated by the reference numerals 122 and 124. The double hook support rack embodiment of FIG. 7 employs a third type metal rod mounting structure for positioning the double hook rack on a building wall stud. The single hook member 122 includes an elongated upper metal rod member 126 which is provided at the front end thereof with an integral upturned metal rod stop member 128. The rear end of the elongated upper metal rod member 126 is integrally connected to a vertical metal rod joint member 130. The lower end of the vertical metal rod joint member 130 is integrally connected to the rear end of an elongated lower metal rod member 132. The elongated lower metal rod member 132 extends upwardly and forwardly at an angle relative to the elongated upper metal rod member 126. The front end 134 of the elongated lower metal rod member 132 is bent to a position parallel to the underside of the elongated upper metal rod member 126 and is fixedly welded thereto.

The other single hook member 124 is constructed identically to the first described single hook member 122 and the parts thereof have been marked with the same reference numerals followed by the small letter "f". The double hook support rack embodiment of FIG. 7 includes a mounting structure which comprises an upper mounting structure portion, generally indicated by the numeral 136, and a lower mounting structure portion, generally indicated by the numeral 138. The upper mounting structure portion 136 includes a transverse metal rod arm member 140 which has the ends thereof, fixedly secured as by welding, to the upper ends of the vertical metal rod joint members 130 and 130*f*. Integrally attached to the outer ends of the mounting structure transverse metal rod arm member 140 are a pair of mounting structure positioning arms 142 and 144 which are formed from metal rods and bent rearwardly at right angles to the mounting structure transverse metal rod arm member 140.

The lower mounting structure portion 138 is constructed similarly to the upper mounting structure portion 136. The lower mounting structure portion 138 includes a mounting structure transverse metal rod arm member 146 which is fixedly connected, as by welding, to the lower ends of the vertical joint rod members 130 and 130*f*. A mounting structure rearwardly extended metal rod positioning arm is integrally attached to each end of the mounting structure transverse arm member 146, and they are designated by the numerals 148 and 150.

The double hook support rack illustrated in FIG. 7 would be made for use on a building stud 199, or building post, having a vertical predetermined width, with or without dry wall covering. In use the double hook support rack illustrated in FIG. 7 would be mounted on the building stud with the upper and lower mounting structure transverse arm members 140 and 146 seated against the face of the stud, and the mounting structure positioning arms 142 and 148 seated on one of the side surfaces of the stud and the mounting structure positioning arms 144 and 150 seated on the other side surface of the stud. The double hook support rack illustrated in FIG. 7 would be fixedly secured to a stud by means of a pair of upper attachment metal washers 152 and a pair of suitable dry wall attachment screws 154. A third lower attachment metal washer 152 would also be employed to secure the lower end of the support rack to the stud by means of a suitable dry wall attachment screw 154. If desired, the aforementioned attachment metal washers 152 could be welded to the respective mounting structure transverse arm members 140 and 146. The upper attachment metal washers 152 could also be additionally fixed, as by welding to the vertical metal rod joint members 130 and 130*f*.

Figure 8:
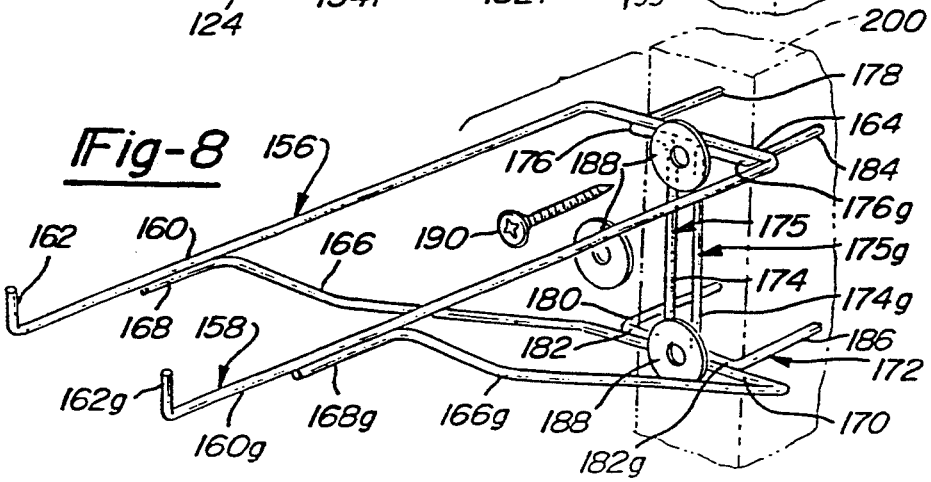
FIG. 8 is an elevation perspective view, of the double hook support rack shown in FIG. 7, and which employs a fourth type metal rod mounting structure.

FIG. 8 is perspective view of a double hook support rack embodiment which employs a pair of single hook members, generally designated by the numerals 156 and 158. The double hook support rack embodiment of FIG. 8 employs a fourth type metal rod mounting structure for positioning the double hook rack on a building wall stud indicated by the numeral 200. The single hook member 156 includes an upper elongated metal rod member 160 which is provided at the front end thereof with an integral upturned metal rod stop member 162. The rear end of the elongated upper metal rod member 160 is integrally connected to one end of an upper transverse metal rod joint arm member 164. The single hook member 156 includes an elongated lower rod member 166 which has its rear end integrally connected to one end of a lower transverse metal rod joint arm member 170. The elongated lower metal rod member 166 extends upwardly and forwardly at an angle relative to the elongated upper metal rod member 160. The front end 168 of the elongated lower metal rod member 166 is bent into a position parallel to the underside of the elongated upper metal rod member 160 and is fixedly welded thereto.

The other single hook member 158 is constructed identical to the first described single hook member 156, and the parts thereof have been marked with the same reference numerals followed by the small letter "g". The rear end of the elongated upper metal rod member 160*g* is integrally attached to the other end of the transverse metal rod joint arm member 164. The rear end of the elongated lower metal rod member 166*g* is integrally connected to the other end of the transverse metal rod joint arm member 170.

The double hook support rack embodiment of FIG. 8 includes a mounting structure, generally indicated by the numeral 172, and which includes left and right mounting structure portions, designated generally by the reference numerals 175 and 175*g*, respectively. The left mounting structure portion 175 includes a vertical metal rod arm 174 which is integrally connected at its upper end to the inner end of a transverse metal rod horizontal arm 176. An upper mounting structure positioning arm 178 has the front end thereof integrally connected to the outer end of the transverse metal rod horizontal arm 176, and it is bent rearwardly at a right angle therefrom, and is disposed parallel to the elongated upper metal rod member 160. A lower mounting structure positioning arm 180 has the front end thereof integrally connected to the outer end of a transverse metal rod horizontal arm 182, and it is bent rearwardly at a right angle therefrom, and is disposed parallel to the elongated upper metal rod member 160. The top surface of the transverse metal rod horizontal arm 176 is welded to the lower surface of the transverse metal rod joint arm member 164. The lower surface of the transverse metal rod horizontal arm 182 is welded to the upper surface of the transverse metal rod joint arm member 170.

The right mounting structure portion 175g includes a vertical metal rod arm 174g which is integrally connected at its upper end to the inner end of a transverse metal rod horizontal arm 176g. An upper mounting structure positioning arm 184 has the front end thereof integrally connected to the outer end of the transverse metal rod horizontal arm 176g, and it is bent rearwardly at a right angle therefrom, and is disposed parallel to the elongated upper metal rod member 160g. A lower mounting structure positioning arm 186 has the front end thereof integrally connected to the outer end of a transverse metal rod horizontal arm 182g, and it is bent rearwardly at a right angle therefrom, and is disposed parallel to the elongated upper metal rod member 160g. The top surface of the transverse metal rod horizontal arm 176g is welded to the lower surface of the transverse metal rod joint arm member 164. The lower surface of the transverse metal rod 182g is welded to the upper surface of the transverse metal rod joint arm member 170. The two vertical metal rod mounting structure arms 174 and 174g are laterally spaced apart to provide a vertical gap or opening therebetween for the passage therethrough of attachment screws 190.

The double hook support rack illustrated in FIG. 8 would be used on a building wall stud 200, or a post, having a predetermined width. In use, the double hook support rack illustrated in FIG. 8 would be mounted on the building wall stud 200, with the vertical mounting structure arms 174 and 174g seated centrally, on opposite sides of the centerline of the stud 200, and with the positioning arms 178 and 180 being seated against one side surface of the stud 200, and the positioning arms 184 and 186 being seated against the other side surface of the stud 200.

An upper attachment metal washer 188 is welded to the front side of the upper end of the vertical mounting structure metal rods 174 and 174g, and to the upper transverse metal rod joint arm member 164. A lower attachment metal washer 188 is welded to the front side of the lower ends of the vertical mounting structure metal rods 174 and 174g, and to the lower transverse metal rod joint arm member 170. A third attachment metal washer 188 may be welded to the front side of the vertical mounting structure metal rods 174 and 174g, at a selected position between said upper and lower welded attachment metal washers 188. The double hook support rack illustrated in FIG. 8 is fixedly secured to the stud 200 by suitable dry wall attachment screws 190 mounted through the joint attachment metal washers 188 and into the stud 200.

What is claimed is:

1. A support rack for mounting to an upright post (14) having a front face and two side surfaces, for removably supporting garden equipment, comprising:

(a) at least one elongated hook member (10,65,69) having an inner end **(46,60,46*a*,60*a*,46*b*,60*b*) structure and an outer end (28,34,28*a*,34*a*)** structure;

(b) mounting structure **(12,12*a*)** for positioning said at least one elongated hook member on a front face of an upright post;

(c) joint means **(48,50,62,64,66,66*b*,70,70*b*)** for joining said inner end structure of said at least one elongated hook member to said mounting structure;

(d) attachment means **(52,52*a*)** for fixedly securing said mounting structure to a front face of an upright post;

(e) said mounting structure **(12,12*a*) comprises a channel member having a front wall (18,18*a*) for seating on a front face of an upright post, and a pair of laterally spaced apart, integral side flanges (20,22,20*a*,22*a*) for extension through a wall board if an upright post is covered by a wall board, and for seating on the two side surfaces of an upright post to prevent the rack from twisting, relative to the post, which twisting could cause garden equipment supported by the at least one hook member to slip off the hook member; and, (f) said joint means (48,50,62,64,66,66*b*,70, 70*b*)** being carried by said channel member.

2. A support rack for mounting to an upright post (14) having a front face and two side surfaces, for removably supporting garden equipment, comprising:

(a) at least one elongated hook member (10,65 or 69) having an inner end **(46,60,46*a*,60*a*,46*b*,60*b*)structure and an outer end (28,34,28*a*,34*a*)** structure;

(b) mounting structure **(12,12*a*)** for positioning said at least one elongated hook member on a front face of an upright post;

(c) joint means **(48,50,62,64,66,66*b*,70,70*b*)** for joining said inner end structure of said at least one elongated hook member to said mounting structure;

(d) attachment means **(52,52*a*)** for fixedly securing said mounting structure to a front face of an upright post;

(e) said mounting structure **(12,12*a*) comprises a channel member having a front wall (18,18*a*) for seating on a front flange of an upright post, and a pair of laterally spaced apart, integral side flanges (20,22,20*a*,22*a*)** for extension through a wall board if an upright post is covered by a wall board, and for seating on the two side surfaces of an upright post to prevent the rack from twisting, relative to the post, which twisting could cause garden equipment supported by the at least one hook member to slip off the hook member;

(f) said joint means **(48,50,62,64,66,66*b*,70,70*b*)** being carried by said channel member;

(g) said mounting structure channel member **(12,12*a*) is provided on the front wall (18,18*a*) thereof with upturned flange means (40,54,40*a*,54*a*) for receiving said joint means (48,50,62,64,66,66*b*,70,70*b*)**;

(h) said mounting structure channel member front wall **(18,18*a*) and upturned flange means (40,54,40*a*,54*a*) having attachment openings (42,44,56,58) formed therethrough; and, (i) said attachment means comprises attachment screws (52,52*a*)** for mounting though said openings in said upturned flange means and channel member front wall and into the front face of said upright post for fixedly securing said mounting structure to said upright post.

3. A support rack as defined in claim 2, wherein:

(a) said upturned flange means on said mounting structure channel member front wall comprises an upper flange (40) and a lower flange (54);

(b) said at least one elongated hook member includes an elongated upper metal rod member (26) having an inner end structure (46) and an elongated lower metal rod member (32) having an inner end structure (60); and, (c) said joint means includes a first joint member (48) integrally attached to the inner end structure (46) of said elongated upper metal rod member (26) for seating on said upper flange (40) on the front wall (18) of said mounting structure channel member (12), and said joint means includes a second joint member (62) integrally attached to the inner end structure (60) of said elongated lower metal rod member (32) for seating on said lower flange (54) on the front wall (18) of said mounting structure channel member (12).

4. A support rack as defined in claim 3, wherein:

(a) the elongated lower metal rod member (32) is disposed in vertical alignment with the elongated upper metal rod member (26), each of said elongated upper (26) and lower (32) rod members have an outer (28,34) and an inner end (46, 60) structure and the elongated lower metal rod member (32) slopes downwardly toward the mounting structure channel member (12) so that the inner end structure (60) on the elongated lower metal rod member (32) is spaced vertically downward from the inner end structure (46) on the elongated upper metal rod member (26) so as to form a triangular configuration between the two elongated metal rod members (26,32).

5. A support rack as defined in claim 4, wherein:

(a) a stop member (30) is connected to the outer end (28) of the elongated upper metal rod member (26) to prevent garden equipment mounted on the support rack from slipping off the support rack.

6. A support rack as defined in claim 4, wherein:

(a) said support rack includes a pair of said elongated hook members (65,69); and, (b) the joint members on the inner end structure of the elongated upper and lower metal rod members, on each of the elongated hook members (65,69) comprise transverse integral metal rod joint members (66,66*b*,70,70*b*), which are adjustably mounted for sidewise adjustment in their seating positions on said upper (40*a*) and lower (54*a*) mounting structure flanges for positioning the pair of elongated hook members (65,69) laterally apart.

7. A support rack as defined in claim 6, wherein:

(a) each of said transverse integral metal rod joint members (66,66*b*,70,70*b*) have a free end on which is integrally formed a stop member (68,68*b*,72,72*b*) to limit the lateral adjustment of said elongated hook members (65,69).

8. A support rack for mounting to an upright post (14) having a front face and two side surfaces, for removably supporting garden equipment, comprising:

(a) at least one elongated hook member (75) having an inner end (46*c*,60*c*) structure and an outer end structure;

(b) mounting structure (12*c*) for positioning said at least one elongated hook member centrally on a front face of an upright post;

(c) joint means (86,88) for joining said inner end structure of said at least one elongated hook member to said mounting structure;

(d) attachment means (52*c*) for fixedly securing said mounting structure to a front face of an upright post; and, (e) said mounting structure (12*c*) comprises a vertical metal rod (76) for seating along the centerline of an upright post (14*c*), and a pair of integral metal rod positioning members (78,80,82,84) integrally attached to the vertical rod member (76), in vertically spaced apart positions, and each of which have a portion (80,84) thereof bent to extend rearwardly for seating engagement against one side of an upright post, and for extension through a wall board if an upright post is covered by a wall board, and for seating against one side of the upright post (14*c*).

9. A support rack for mounting to an upright post (14,199,200), having a front face and two side surfaces, for removably supporting garden equipment, comprising:

(a) a pair (90,92,122,124,156,158) of elongated, laterally spaced apart, hook members;

(b) each of said hook members having an inner end structure and an outer end structure;

(c) mounting structure (12*d*,12*e*,136,138,172) for positioning said pair of elongated hook members on a front face of an upright post;

(d) joint means (94,100,106,112,130,130*f*,164,170) for joining said inner end structure of said pair of elongated hook members to said mounting structure;

(e) attachment means (120,154,190) for fixedly securing said mounting structure to a front face of an upright post; and, (f) said mounting structure (12*d*,12*e*,136, 138,172) comprises a pair of laterally spaced apart upper, and a pair of laterally spaced apart lower, integral positioning arms (98,104,110,116) (142,144,148,150) (178,184,180, 186) attached to the inner end structure of said pair of elongated hook members for extension through a wall board if an upright post is covered by a wall board, and for seating engagement against opposite side surfaces of an upright post to prevent the support rack from twisting, relative seating engagement against opposite side surfaces of an to the post, which twisting could cause garden equipment supported by the hook members to slip off the hook members.

* * * * *

UNITED STATES PATENT AND TRADEMARK OFFICE

CERTIFICATE OF CORRECTION

PATENT NO. : 5,388,709

DATED : February 14, 1995

INVENTOR(S) : Thomas F. Adams

It is certified that error appears in the above-indentified patent and that said Letters Patent is hereby corrected as shown below:

Column 12, line 29, "flange" should be --face--.

Column 14, line 49, delete "seating engagement against opposite side".

Column 14, line 50, delete "surface of an".

Signed and Sealed this

Eighteenth Day of April, 1995

Bruce Lehman

*Attest:*

BRUCE LEHMAN

*Commissioner of Patents and Trademarks*

*Attesting Officer*